United States Patent [19]

Zajeski

[11] Patent Number: 4,553,801

[45] Date of Patent: Nov. 19, 1985

[54] LOCKING AND POLARIZING HEADER

[75] Inventor: Robert B. Zajeski, Hickory Hills, Ill.

[73] Assignee: Panduit Corp., Tinley Park, Ill.

[21] Appl. No.: 422,049

[22] Filed: Sep. 23, 1982

[51] Int. Cl.[4] ..... H01R 9/22

[52] U.S. Cl. ..... 339/59 M; 339/184 R; 339/221 R; 339/91 R

[58] Field of Search ..... 339/91 R, 176 M, 59 R, 339/59 M, 184 R, 184 M, 186 R, 186 M, 221 R, 221 M, 276 SF

[56] References Cited

U.S. PATENT DOCUMENTS

| | | | |
|---|---|---|---|
| 3,363,223 | 1/1968 | Hardesty et al. | 339/221 R |
| 3,399,376 | 8/1968 | Pauza et al. | 339/91 R |
| 3,706,954 | 12/1972 | Krafthefer | 339/91 R |
| 4,023,880 | 5/1977 | Powell | 339/59 R |
| 4,030,387 | 10/1980 | Zahn | 339/59 R |
| 4,255,009 | 3/1981 | Clark | 339/97 |

OTHER PUBLICATIONS

Panduit Catalog Ex-Mtcc-1A, Samtec Catalog 178.
Bevg 500 Bulletin, Ap Products Catalog.

*Primary Examiner*—Gil Weidenfeld
*Assistant Examiner*—Thomas M. Kline
*Attorney, Agent, or Firm*—Charles R. Wentzel; Mark D. Hilliard

[57] ABSTRACT

An elongate header for mounting a connector. The header includes a series of insulative L-shaped segments each including a base having an aperture for receiving a header post and further including a resilient, deflectable wall extending from the base. Adjacent segments are joined by interconnection means sufficiently thin that a group of segments can be broken away by hand from the remainder of the segments. The header also includes a post disposed in each aperture, the locking means for cooperating with a component of the connector to lock the connector, once mounted to the header. Finally, the header includes polarizing means for preventing reverse mounting of the connector on the header. Headers of a predetermined number of segments can be removed from an indeterminate length of such segments to preclude the need for a user to carry an inventory of headers of different lengths.

2 Claims, 4 Drawing Figures

LOCKING AND POLARIZING HEADER

BACKGROUND OF THE INVENTION

This invention relates to electrical interconnection components and, more particularly, to a header for mounting a connector and interconnecting wires terminated in the terminal elements of the connector and electric circuits in another electrical component such as a circuit board.

Prior art headers were typically manufactured by extruding or molding the insulative base and thereafter drilling into the base spaced apertures for receiving the metallic header posts in an interference fit. A major component of the retention force resulting from post installations extends between adjacent posts causing a slight bow. As this bowing is in the longitudinal direction of the header, the bowing is cumulative and its extent is a function of the number of header posts. For a header of moderate or long length the bowing can become severe, making it difficult to solder the header to a circuit board and causing an installed header to have an undesirable appearance. One proposed header attempted to overcome the bowing problem by molding the header around prepositioned posts. This molding process involved considerable additional expense because of the complexities involved in the mold tooling.

Headers having additional functions are coming into increasing commercial prominence. For example, a locking header has a latch for holding a mounted connector while a polarizing header allows the connector to be mounted on the header in only one relative orientation. Such headers are typically available only in discrete lengths. Thus, a user installing a variety of different length connectors is required to maintain an extensive inventory of headers to fully cover the number of length, polarizing function, and locking function variations.

SUMMARY OF THE INVENTION

Among the several objects of the present invention may be noted the provision of an improved header which can be manufactured in an indeterminate length and which can be broken by hand to desired length so that a user need not carry a large inventory of different headers; the provision of such which firmly retains the header post while avoiding extensive bowing by orienting retention forces so that any bowing resulting therefrom is noncumulative and/or by providing spaced voids between header posts; the provision of such header which locks a mounted header and which precludes reverse mounting of a connector on the header; and the provision of such header which has long service life and is simple and economical to manufacture. Other objects and features of the present invention will in part be apparent and will in part be pointed out in the following specifications and in the claims attendant thereto.

Briefly, the header of the present invention comprises a series of L-shaped segments each carrying a header post, locking means for retaining a connector mounted on the header, and polarizing means for preventing reverse mounting of the connector. Adjacent segments are joined by interconnection means sufficiently thin that a group of segments can be broken away from the remainder of segments.

BRIEF DESCRIPTION OF THE DRAWINGS

Corresponding reference characters indicate corresponding posts throughout the several views of the drawings.

DESCRIPTION OF THE PREFERRED EMBODIMENT

Figure 1:
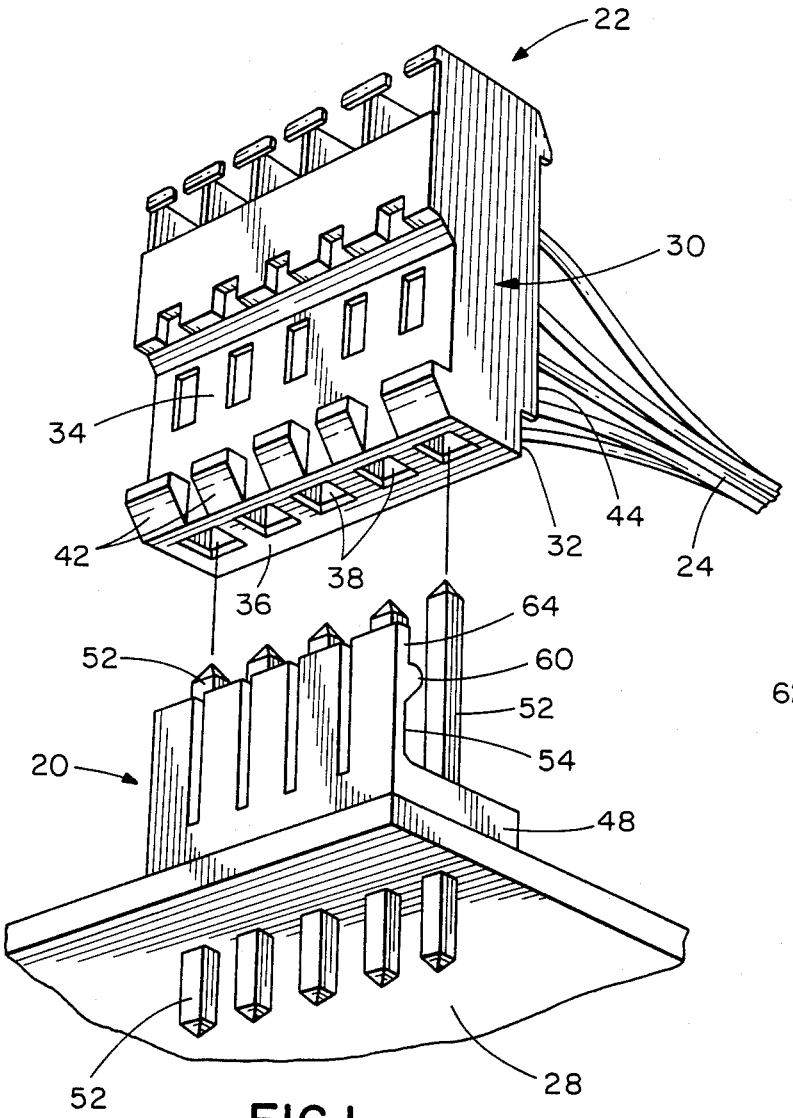
FIG. 1 is a perspective view of the header of the present invention mounted on a circuit board with a connector in position to be mounted on the header.
Figure 2:
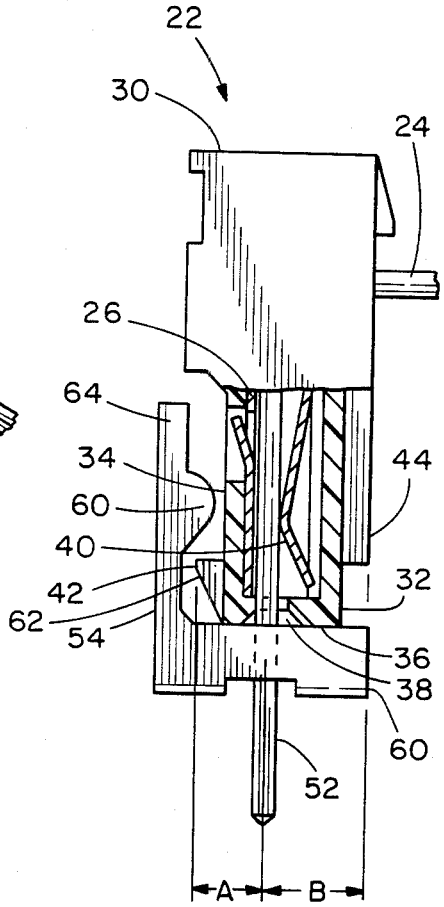
FIG. 2 is a side elevational view of the connector, with certain components removed, mounted on the header of FIG. 1.

Referring now to FIGS. 1 and 2, a header, for mounting a connector 22 and interconnecting wires 24 terminated in the metallic terminal elements 26 of the connector and electric circuits in another electrical component such as circuit board 28, is generally indicated by reference numeral 20. Connector 22 has a housing 30 including a front wall 32, a rear wall 34 and a post-receiving face 36 extending therebetween and having a series of aligned openings 38 for permitting access to post-receiving portions 40 of the terminal elements 26. Rear wall 34 carries a series of locking lugs 42 adjacent face 36 while front wall 32 has a plurality of ribs 44 disposed adjacent face 36. The spacing between a plane through the center lines of those portions of openings 38 to be occupied by header posts when the connector is mounted and a plane tangent to the distal ends of lugs 42 (hereinafter dimension "A") is less than the spacing between the center line plane and a plane tangent to the free ends of ribs 44 (hereinafter dimension "B"). A connector similar to connector 22 is fully illustrated and described in commonly-assigned U.S. Pat. No. 4,191,442.

Header 20 is elongate and includes a series of insulative L-shaped segments 46, preferably of molded thermoplastic construction, with adjacent segments joined by interconnection means sufficiently thin that a group of segments can be broken away by hand from the remainder of the segments. Each segment 46 includes a base 48 having an aperture 50 for receiving a metallic header post 52 and further includes a resilient, deflectable wall 54 extending from the base. Adjacent segments 46 are joined only at the junction of their bases and walls by frangible links 56. It will be appreciated that the header of the present invention precludes the need for an extensive inventory of different sized headers as a header of desired size can easily be removed from a strip of segments 46 of indeterminate length.

Figure 3:
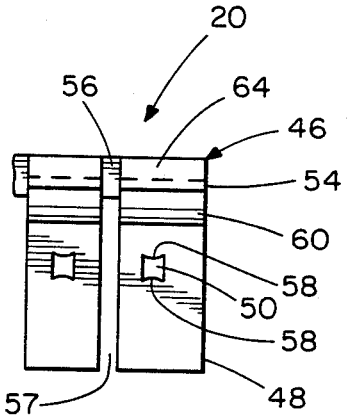
FIG. 3 is an enlarged plan view of a group of joined segments which, in part, constitute the header prior to insertion of metallic header posts.
Figure 4:
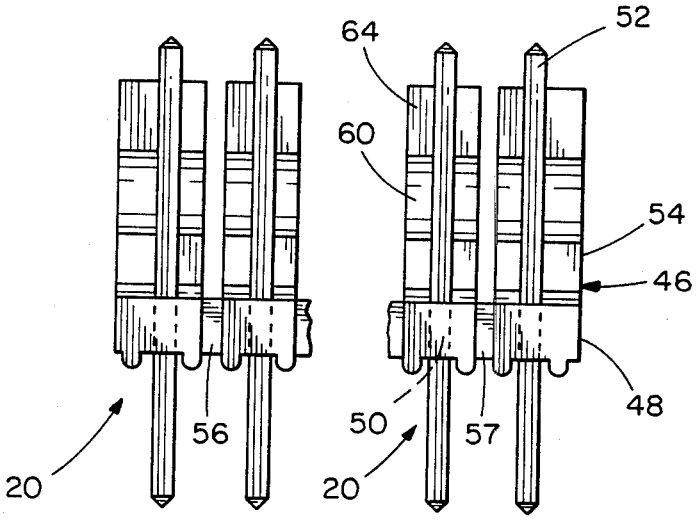
FIG. 4 is a front elevational view of length of header segments with interconnection means broken forming two groups of header segments.

As best shown in FIG. 3, the aperture 50 in each base 48 has a dimension in the longitudinal direction of the header which is complimentary (substantially identical) to the corresponding cross-sectional dimension of post 52. However, in a direction transverse to the longitudinal direction of the header, each aperture has a dimension which is less than the corresponding cross-sectional dimension of the header. The resultant of retention forces caused in the base by post insertion is directed transverse to the header longitudinal direction. Although this may result in a slight transverse bowing in each base, any bowing is noncumulative with that in other bases. Links 56 interconnect bases 48 only at their edges forming a void 57 between adjacent posts 52. Any expansion of a base due to longitudinal bowing, if any, is absorbed by voids 57. As links 56 offer a limited degree of flexibility, the presence of the voids insures that even longitudinal bowing is noncumulative. In prior art headers, insertion of posts in apertures often resulted in longitudinal bowing between adjacent posts. If the header had a moderate to large number of posts, the resultant cumulative bowing could be extensive. The transverse constricted dimension of each aperture 50 is preferably formed by opposing convexities 58. It should be appreciated that apertures 50 with convexities 58 cooperate so that a header post of either round or square cross section can be used.

Header 20 also comprises locking means for cooperating with lugs 42 of the connector housing to lock the connector, once mounted, to the header and further comprises polarizing means for preventing reverse mounting of connector 22 on the header. More specifically, the locking means comprises a protuberance 60 disposed on each segment wall and extending inwardly. The lugs 42 of the connector housing are provided with cam surfaces 62 for engaging the protuberances to deflect the segment walls. With a long connector and header therefor the mounting force may be relatively high. This mounting force can be reduced by removing certain lugs so that the cumulative longitudinal extent of all connector lugs is less than the cumulative longitudinal extent of all locking protuberances. By selectively removing lugs, it is possibly to mount the connector without deflecting all of the segment walls. It should also be appreciated that as header walls 54 are spaced and separated by voids, they offer less resistance to mounting than would a solid continuous locking wall.

The polarizing means comprises a vertical extension 64 on each segment wall with the spacing extensions 64 and a plane including the center line of the header posts being less than the "B" dimension of the connector but greater than the "A" dimension of the connector. Accordingly, the connector can be mounted on the header with connector back wall 34 facing segment walls 54 without interference from extensions 64. However, upon attempted reverse mounting, extensions 64 will interfere with housing ribs 44 to prevent unintended electrical connections.

Operation of the header 20 of the present invention is as follows: After the user determines the necessary number of circuits, removes a header having that number of segments from an indeterminate length of segments, and installs the header on a circuit board by, for example, soldering or wire wrapping techniques; the header is in condition to receive a terminated connector to complete connections between corresponding wires and circuits of the panel board. With proper orientation between the connector and header, movement of the connector toward the header causes lugs 42 to engage protuberances 60 resulting in deflection of segment walls 54. After the lugs descend past the level of the protuberances, the segment walls return to their undeflected positions wherein the protuberances overlie the lugs to retain the connector. While an installed connector is able to be intentionally removed from the header, albeit with some difficulty; the protuberances effectively lock the connector against unintended removal due, for example, to vibration present in industrial environments.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

I claim:

1. An elongate header for mounting a connector to interconnect wires terminated in said connector and corresponding circuits of another electrical component such as a circuit board, said header comprising:

a series of insulative L-shaped segments joined by frangible interconnection means whereby a group of segments can be broken away by hand from the remainder of said header, each segment including a base having an aperture for receiving a header post and further including a resilient, deflectable wall extending from said base, said group of segments extending in a generally longitudinal direction; and a header post disposed in each aperture, wherein each aperture has a first dimension in said longitudinal direction of said header substantially complimentary to a corresponding cross-sectional dimension of said header post, and each aperture has a dimension transverse to said longitudinal direction of said header which is less than a corresponding cross-sectional dimension of said header post whereby any force applied by said posts to said header is directed transversely to said longitudinal direction and any resulting slight bowing in each segment due to said force is noncumulative with that in other segments to preclude substantial longitudinal bowing of said header, and wherein said transverse dimension of each aperture is defined by opposing convexities.

2. An elongate header for mounting a connector to interconnect wires terminated in said connector and corresponding circuits of another electrical component such as a circuit board, said header comprising:

a series of insulative segments each having an L-shaped profile with adjacent segments joined by frangible interconnection means whereby a group of segments can be broken away by hand from the remainder of said header, each segment including a base having an aperture for receiving a header post, said apertures of said series of L-shaped segments being disposed in an aligned row substantially parallel to the length of said header, each of said segments further including a resilient, deflectable wall extending normally from said base, said group of segments extending in a generally longitudinal direction with the adjacent segments being interconnected only at junctions of said bases and walls by said frangible interconnection means such that adjacent bases are not connected substantially beyond the thickness of said wall, said bases being spaced apart to define voids intersecting and extending beyond said aligned row of said apertures whereby longitudinal bowing of said header induced by the insertion of a header post within said aperture is noncumulative; and a header post disposed in each aperture.

* * * * *